US008561341B1

(12) United States Patent
Dihlmann

(10) Patent No.: US 8,561,341 B1
(45) Date of Patent: Oct. 22, 2013

(54) RIFLE SCOPE ALIGNMENT ASSEMBLY

(76) Inventor: Wenzel Dihlmann, Centerville, OH (US)

( * ) Notice: Subject to any disclaimer, the term of this patent is extended or adjusted under 35 U.S.C. 154(b) by 0 days.

(21) Appl. No.: 13/430,851

(22) Filed: Mar. 27, 2012

(51) Int. Cl.
*F41G 1/54* (2006.01)

(52) U.S. Cl.
USPC ..... 42/126; 42/120

(58) Field of Classification Search
USPC ..... 42/126, 127, 129, 133, 136, 137, 140, 42/143, 148
See application file for complete search history.

(56) References Cited

U.S. PATENT DOCUMENTS

| | | | | |
|---|---|---|---|---|
| 4,095,347 | A | 6/1978 | Steffan | |
| 5,442,860 | A | 8/1995 | Palmer | |
| 5,878,504 | A * | 3/1999 | Harms | 42/120 |
| 6,681,494 | B1 * | 1/2004 | Bowden | 33/379 |
| 6,813,855 | B2 | 11/2004 | Pinkley | |
| 6,862,833 | B1 * | 3/2005 | Gurtner | 42/120 |
| D530,775 | S | 10/2006 | LaCorte | |
| 2009/0049733 | A1 | 2/2009 | Matthews | |

* cited by examiner

*Primary Examiner* — Bret Hayes
*Assistant Examiner* — Riginald Tillman, Jr.
(74) *Attorney, Agent, or Firm* — Kyle Fletcher

(57) ABSTRACT

The rifle scope alignment assembly of translucent construction enables alignment of a scope with respect to a rifle, and which is secured onto the scope via a rubber band encircling a portion of the assembly and a rearmost scope mount. The rifle scope alignment assembly includes a horizontal alignment plate that extends and retracts downwardly with respect to a housing, and which includes a groove that touch a top portion of a rifle barrel. The housing includes scope rest pins that extend rearwardly, and which engage the upper, exterior surface of the scope, and in concert with the groove of the horizontal alignment plate enable horizontal alignment of the scope with respect to the rifle. The housing is attached against a vertical alignment plate that includes a plurality of horizontal lines, which are used with the scope's cross hairs to vertically align said scope.

15 Claims, 8 Drawing Sheets

RIFLE SCOPE ALIGNMENT ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of rifle, and scopes, more specifically, an assembly that aids in alignment of the scope on a rifle.

B. Discussion of the Prior Art

As will be discussed immediately below, no prior art discloses a rifle scope alignment assembly that is constructed of translucent construction; wherein a horizontal alignment plate is secured adjacent to a vertical alignment plate via a housing, and which collectively engage an end of a rifle scope via a rubber band; wherein the horizontal alignment plate has a groove for engagement atop of a rifle barrel, and which can extend and retract along a vertical axis in order to adjust vertically with respect to the housing, whereas the vertical alignment plate includes a plurality of horizontal lines that scope; wherein scope rest pins extend rearwardly from the housing, and touch along an upper exterior surface of the rifle scope; whereupon attaching the rifle scope alignment assembly onto a rifle scope, the rifle scope can be aligned both vertically and horizontally.

The Matthews Patent Application Publication (U.S. Pub. No. 2009/0049733) discloses a device fitted on the end of a rifle scope for aligning the scope. However, the device does not include a vertical alignment plate or a horizontal alignment plate that attach onto an end of a rifle scope via a rubber abdn, and which enable alignment of a scope there about.

The Palmer Patent (U.S. Pat. No. 5,442,860) discloses a device fitted on a rifle for cross hair alignment of a mounted scope. However, the device clamps onto the barrel of the rifle, and not onto an end of the scope via a rubber band, and which enables for vertical and horizontal alignment respectively.

The Steffan Patent (U.S. Pat. No. 4,095,347) discloses a device fitten on the end of the barrel of a rifle used for aligning the scope's cross hairs. However, the device does not secure against an end of a scope via a rubber band, and which enables for alignment of the cross hairs.

The Gurtner Patent (U.S. Pat. No. 6,862,833) discloses a cap fitted on the end of a rifle scope for cross hair alignment. However, the cap does not provide both a vertical and horizontal alignment by securement about an end of a scope via a rubber band, and which includes a vertical alignment plate that has a groove for engaging the top portion of a rifle barrel.

The Pinkley Patent (U.S. Pat. No. 6,813,855) discloses a gun sight alignment device that is removed from the firearm. However, the alignment device does not attach onto a distal end of the scope via a rubber band and scope rest pins, and which enables alignment thereon.

While the above-described devices fulfill their respective and particular objects and requirements, they do not describe a rifle scope alignment assembly of translucent construction; wherein a horizontal alignment plate is secured adjacent to a vertical alignment plate via a housing, and which collectively engage an end of a rifle scope via a rubber band; wherein the horizontal alignment plate has a groove for engagement atop of a rifle barrel, and which can extend and retract along a vertical axis in order to adjust vertically with respect to the housing, whereas the vertical alignment plate includes a plurality of horizontal lines that provide a means of alignment with the cross hairs of the rifle scope; wherein scope rest pins extend rearwardly from the housing, and touch along an upper exterior surface of the rifle scope; whereupon attaching the rifle scope alignment assembly onto a rifle scope, the rifle scope can be aligned both vertically and horizontally. In this regard, the rifle scope alignment assembly departs from the conventional concepts and designs of the prior art.

SUMMARY OF THE INVENTION

The rifle scope alignment assembly of translucent construction enables alignment of a scope with respect to a rifle, and which is secured onto the scope via a rubber band encircling a portion of the assembly and a rearmost scope mount. The rifle scope alignment assembly includes a horizontal alignment plate that extends and retracts downwardly with respect to a housing, and which includes a groove that touch a top portion of a rifle barrel. The housing includes scope rest pins that extend rearwardly, and which engage the upper, exterior surface of the scope, and in concert with the groove of the horizontal alignment plate enable horizontal alignment of the scope with respect to the rifle. The housing is attached against a vertical alignment plate that includes a plurality of horizontal lines, which are used with the scope's cross hairs to vertically align said scope.

An object of the invention is to provide an alignment assembly for a scope that attaches itself onto the scope via a rubber band, and which enables both vertical and horizontal alignment of said scope with respect to a rifle.

An even further object of the invention is to secure the assembly by use of the rubber band to encircle both a portion of the assembly and a rearmost scope mount, and in concert with the groove and the scope rest pins.

Another object of the invention is to provide horizontal alignment plate that extends and retracts vertically with respect to a housing, and which includes a groove upon a bottom edge for engagement of a top half of a rifle barrel, and in connection with scope rest pins enables horizontal alignment of the scope.

An even further object of the invention is to provide the scope rest pins extending rearwardly with respect to the housing, and which engages a top, exterior surface of the scope.

Another object of the invention is to provide an assembly constructed of components having translucent qualities that enable viewing through the assembly, and which allows for the vertical alignment via lines provided on the vertical alignment plate.

Another object of the invention is to provide the vertical alignment plate that attaches onto the housing, and which includes a plurality of vertical alignment lines, which are used in concert with the cross hairs of the scope to perform vertical alignment.

These together with additional objects, features and advantages of the rifle scope alignment assembly will be readily apparent to those of ordinary skill in the art upon reading the following detailed description of presently preferred, but nonetheless illustrative, embodiments of the rifle scope alignment assembly when taken in conjunction with the accompanying drawings.

In this respect, before explaining the current embodiments of the rifle scope alignment assembly in detail, it is to be understood that the rifle scope alignment assembly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rifle scope alignment assembly.

It is therefore important that the claims be regarded as including such equivalent construction insofar as they do not depart from the spirit and scope of the rifle scope alignment assembly. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
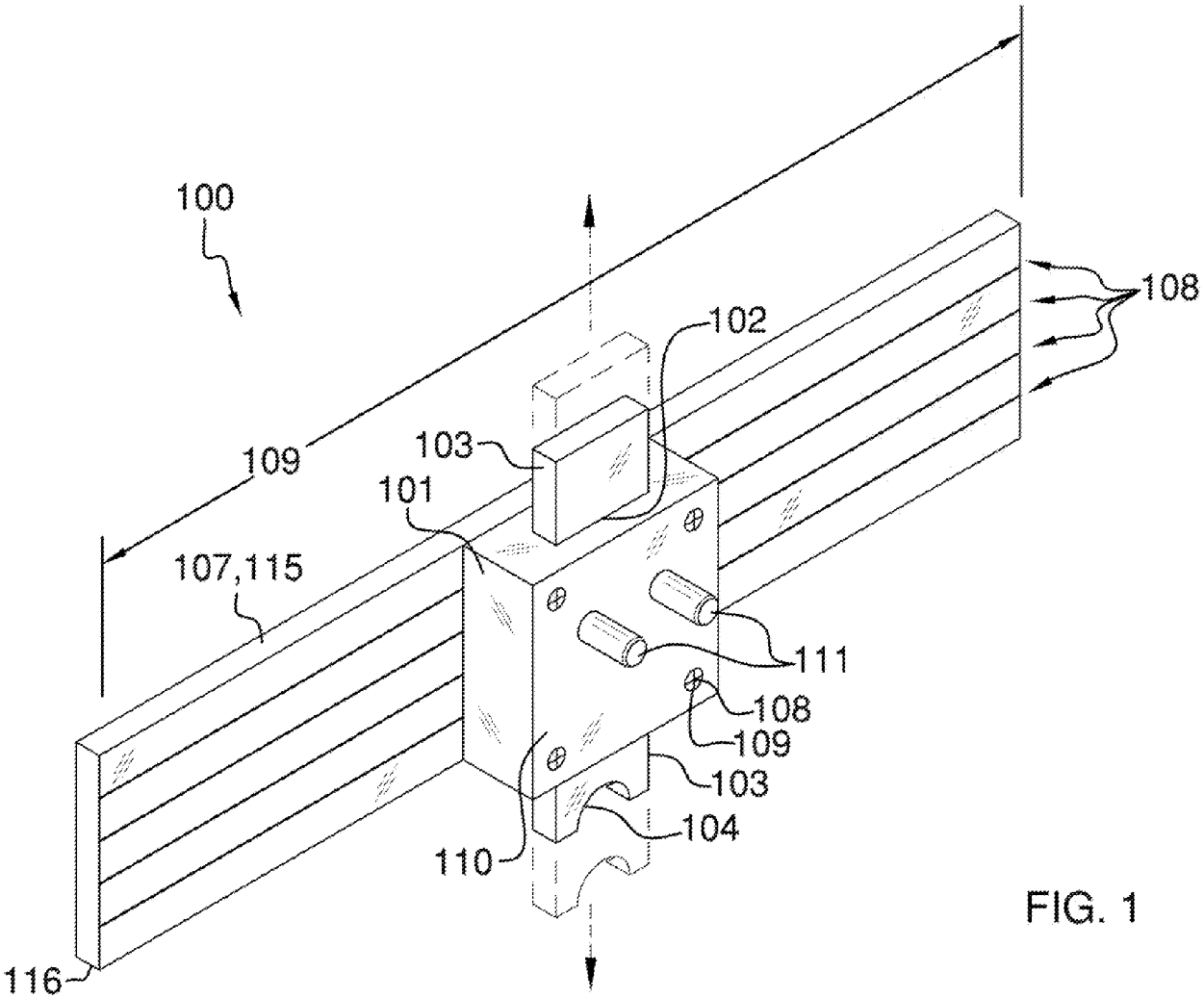
FIG. 1 illustrates a perspective view of the rifle scope alignment assembly by itself in which the horizontal alignment plate is moving up and down with respect to the housing.
Figure 3:
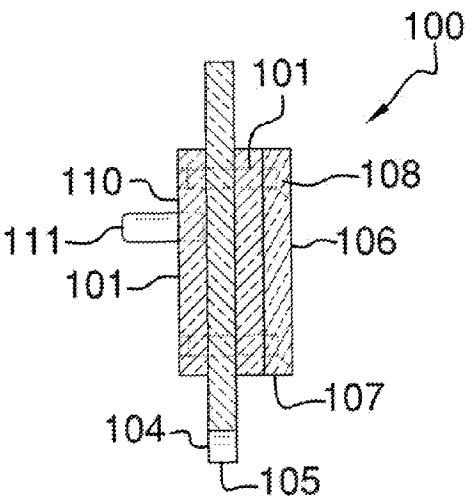
FIG. 3 illustrates a cross-sectional view of the rifle scope alignment assembly along line 3-3 in FIG. 2, and detailing the inter-relation of the housing, vertical alignment plate, horizontal alignment plate, and the scope rest pins.

The following detailed description is merely exemplary in nature and is not intended to limit the described embodiments of the application and uses of the described embodiments. As Used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-8. A rifle scope alignment assembly 100 (hereinafter invention) includes a housing 101 further defined by a vertical slot 102 within which a horizontal alignment plate 103 can slide up or down with respect to the housing 101. The horizontal alignment plate 103 includes a groove 104 at a first distal end 105, which is designed to engage a top half of a rifle barrel 130.

The housing 101 attaches along a rear surface 106 to a vertical alignment plate 107. The vertical alignment plate 107 and the housing 101 attach to one another via a plurality of screws 108 that screw into threaded holes 109 provided on the housing 101 and the vertical alignment plate 107. The vertical alignment plate 107 is an elongated rectangularly-shaped object that is oriented along a horizontal axis 150 whereas the horizontal alignment plate 103 is oriented along a vertical axis 160 (see FIG. 2).

The housing 101, the horizontal alignment plate 103, and the vertical alignment plate 107 are made of a translucent material that enables light to pass through, and which is required to allow for proper alignment. The housing 101, the horizontal alignment plate 103, and the vertical alignment plate 107 shall be machined to tolerances as needed to enable proper alignment.

The vertical alignment plate 107 includes a plurality of vertical alignment lines 108 that extend along a length 109 of the vertical alignment plate 107. The vertical alignment lines 108 are equally spaced and parallel with one another. The vertical alignment lines 108 are used to align a scope 131 vertically along the vertical axis 160, and which will be discussed more below.

The housing 101 is further defined with a rear surface 110 upon which a pair of scope rest pins 111 extend. It shall be noted that the scope rest pins 111 extend rearwardly with respect to the invention 100. Moreover, the location of the scope rest pins 111 is pre-determined such that an objective edge 133 rests under the scope rest pins 111. More specifically, the objective edge 133 is the outer edge of the objective lens 132 of the scope 131. That being said, the objective edge 133 of the objective lens 132 rests against the rear surface 110 of the housing 101.

Figure 2:
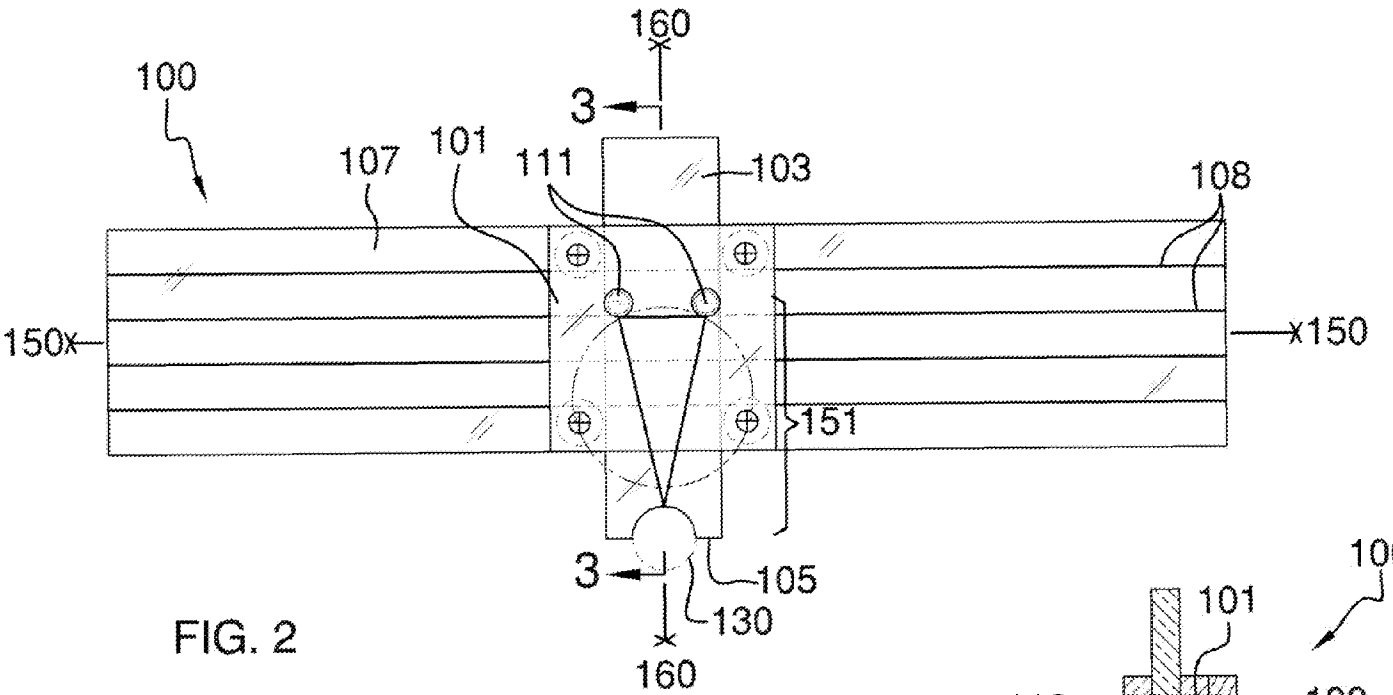
FIG. 2 illustrates a front view of the rifle scope alignment assembly in which a circle depicts placement of an end of a scope under the scope rest pins and a second circle depicts a rifle barrel aligned within the groove of the horizontal alignment plate.
Figure 2A:
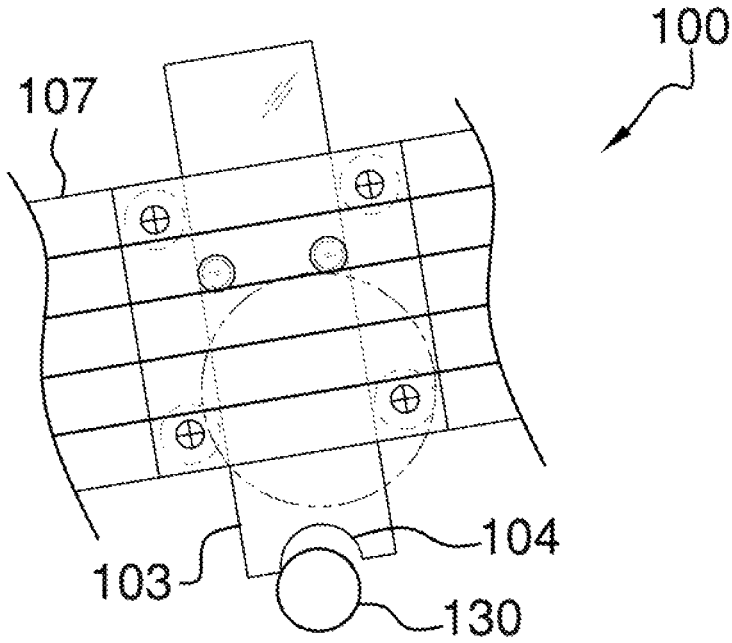
FIG. 2A illustrates misalignment a misalignment of the rifle scope alignment assembly with respect to the scope and rifle barrel.

It shall be noted that upon proper placement of the groove 104 of the horizontal alignment plate 103 with respect to the rifle barrel 130 in conjunction with proper placement of the scope rest pins 111 above and against an outer surface 134 of the objective lens 132, the scope 130 is then horizontally aligned with respect to a rifle 135. In referring to FIGS. 2 and 2A, it shall be noted that horizontal alignment is not achieved until the rifle barrel 130 fits snuggly within the groove 104 and the scope rest pins 111 equally rest against the outer surface 134 of the objective lens 132. When proper horizontal alignment occurs, a horizontal alignment triangle 151 forms therein. Once the scope 130 is horizontally aligned with respect to the rifle 135, the vertical alignment of the scope 130 is able to occur.

Figure 4:
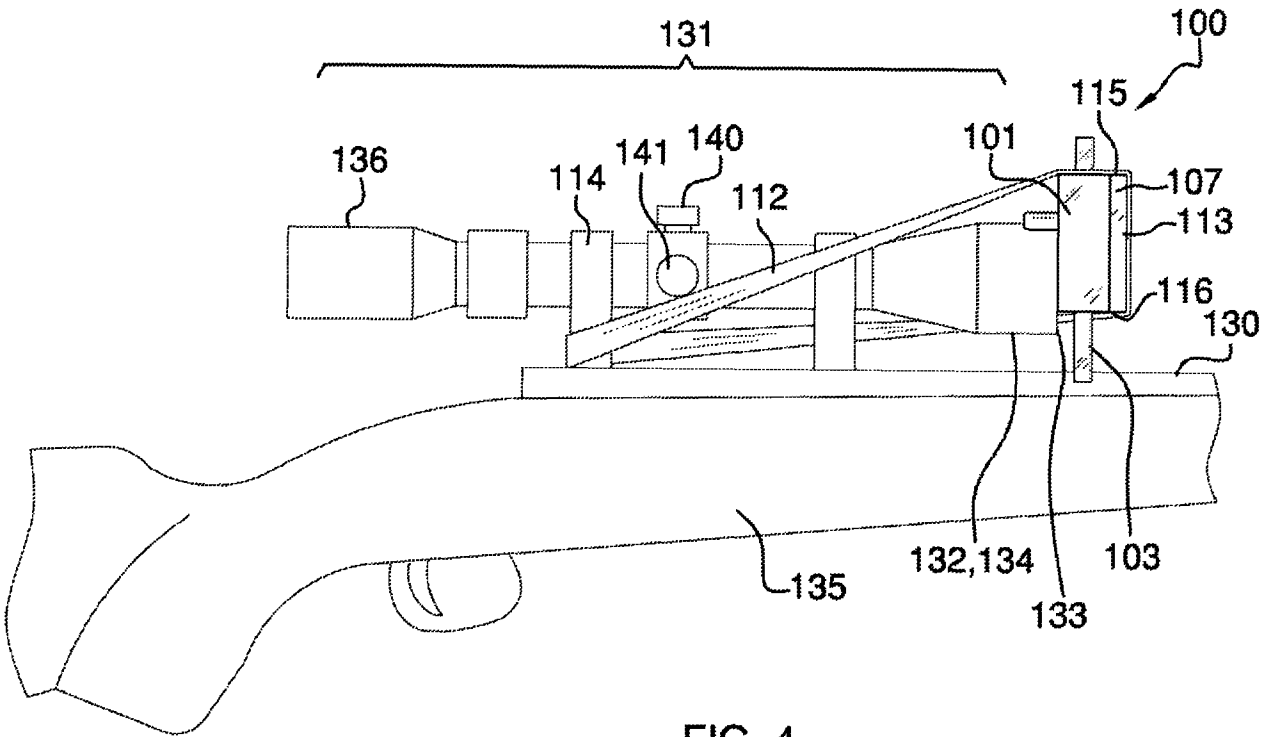
FIG. 4 illustrates a side view of the rifle scope alignment assembly installed onto the scope via the rubber band, and the horizontal alignment plate seated atop of the rifle barrel.
Figure 5:
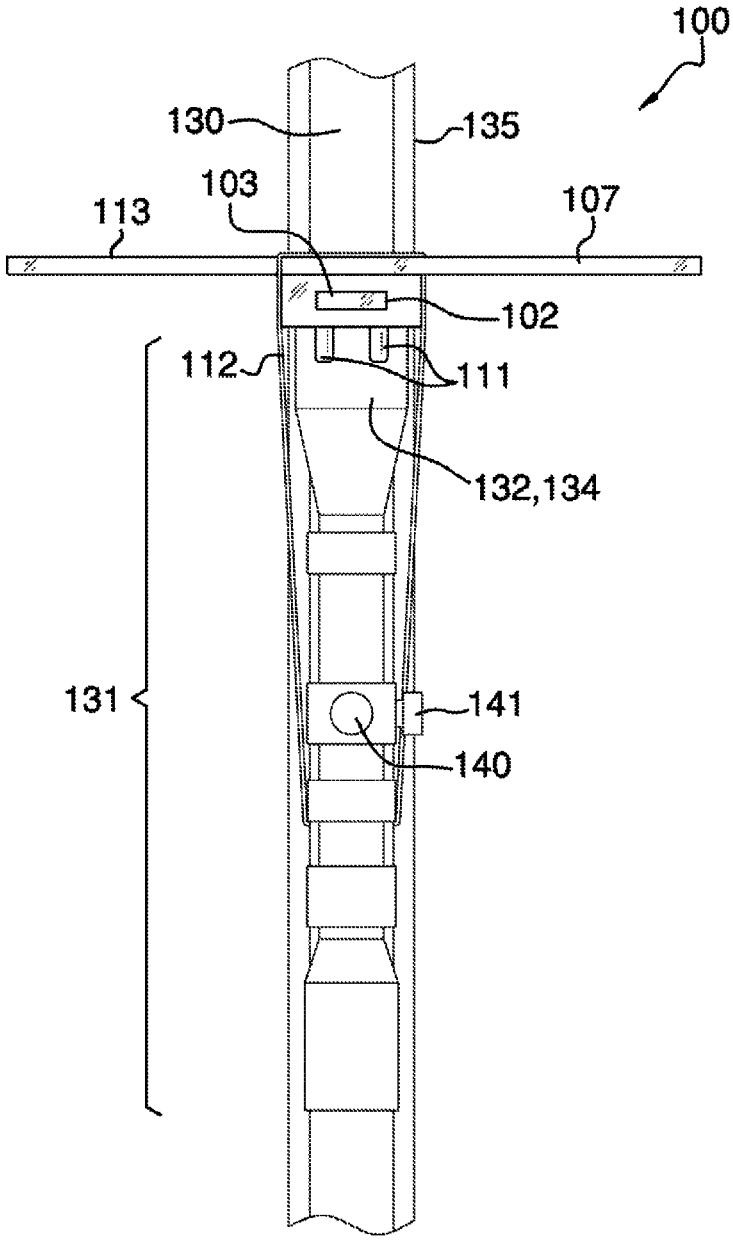
FIG. 5 illustrates a top view of the rifle scope alignment assembly installed onto the scope via the rubber band.
Figure 6:
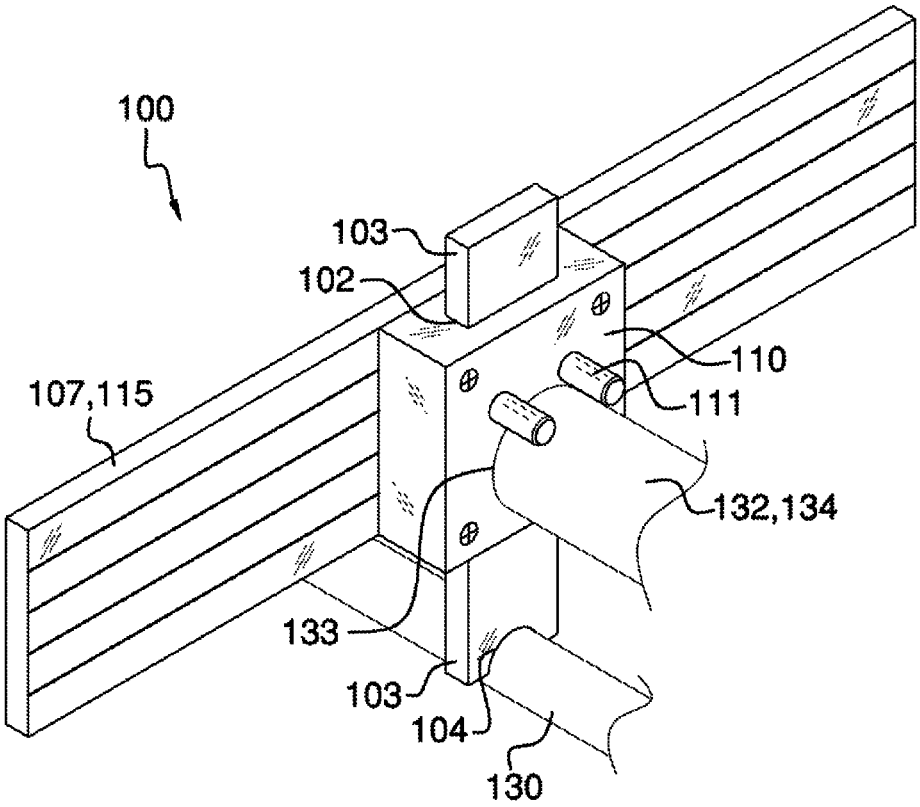
FIG. 6 illustrates a detailed perspective view of the rifle scope alignment assembly installed onto the scope.

A rubber band 112 of an undefined length is included with the invention 100, and is responsible for securing the invention 100 to the objective lens 132 of the scope 130. Referring to FIGS. 4 and 5, the rubber band 112 encircles a front surface 113 of the vertical alignment plate 107 and a rearmost scope mount 114. It shall be noted that the rubber band 112 traverses a top edge 115 of the vertical alignment plate 107, across the front surface 113 of the vertical alignment plate 107, and then over a bottom edge 116. It shall be noted that the rubber band 112 shall secure the invention 100 onto the scope 130 prior to horizontal alignment or vertical alignment.

Figure 7:
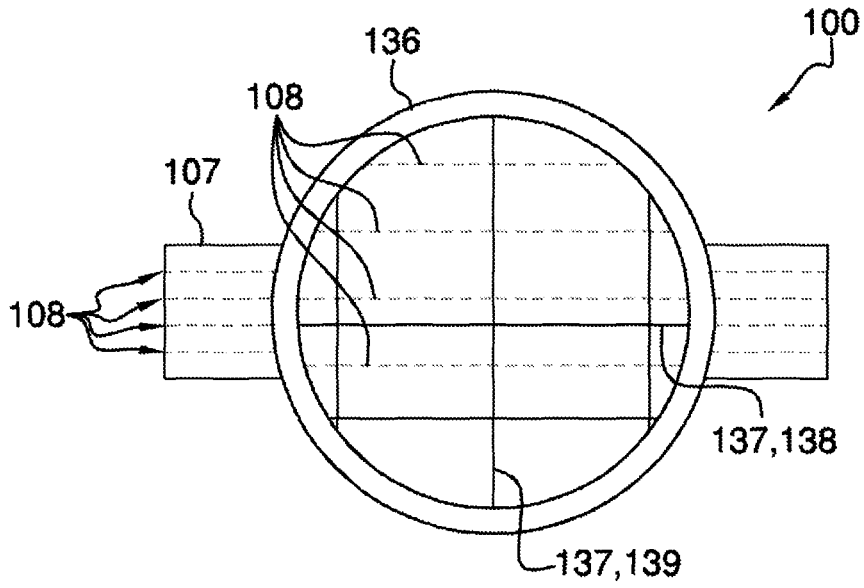
FIG. 7 illustrates an eye view into the scope in which the vertical lines of the vertical alignment plate do not align with cross hairs of the scope.
Figure 8:
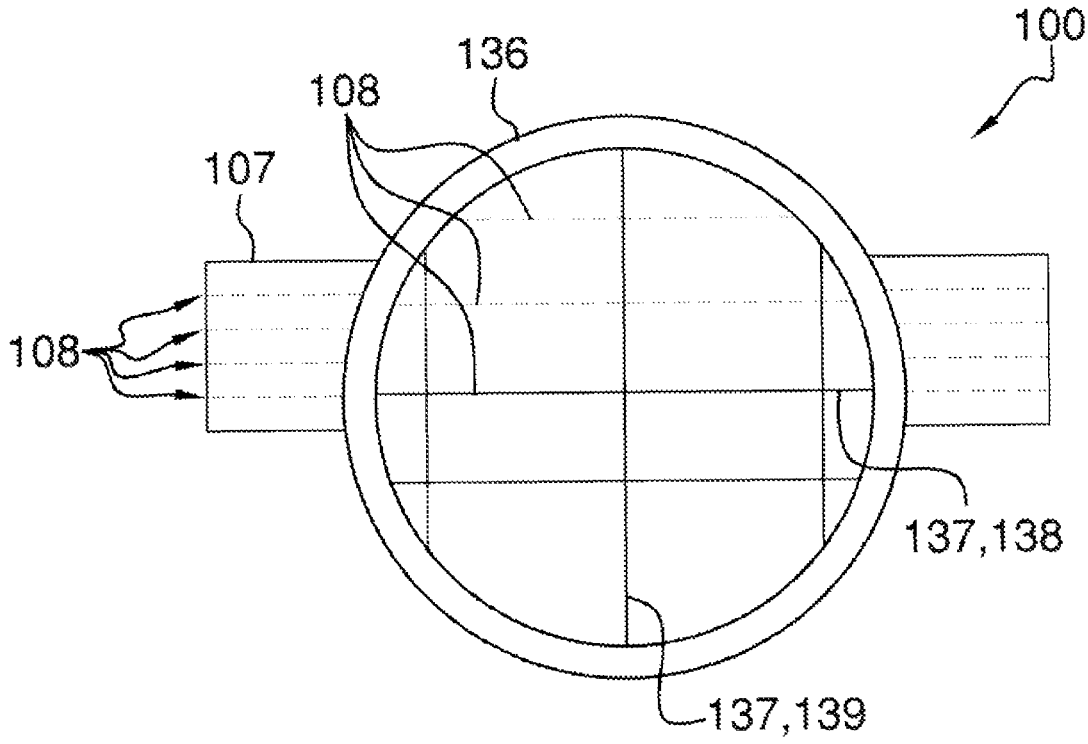
FIG. 8 illustrates an eye view into the scope in which a designated vertical line is aligned with the horizontal cross hair of the scope, which shows proper alignment of the scope with respect to the rifle.

Upon horizontal alignment, the invention 100 is used to vertically align the scope 130 with respect to the rifle 135. Referring to FIGS. 7 and 8, an ocular lens 136 of the scope 130 is used to see the vertical alignment lines 108 of the vertical alignment plate 107, and more importantly, to align cross hairs 137 of the scope 130 with one of the vertical alignment lines 108. It shall be noted that depending upon the size of the scope 130 in connection with the location and spacing of the scope rest arms 111 will dictate which vertical alignment line 108 to use in connection with the cross hairs 137. It shall be noted that the cross hairs 137 are further defined as a horizontal cross hair 138 and a vertical cross hair 139. Moreover, vertical alignment of the scope 130 requires alignment of the horizontal cross hair 138 with one of the vertical alignment lines 108.

It shall be noted that the vertical alignment and horizontal alignment of the scope 130 with respect to the rifle 135 shall require manipulation of an elevation turret 140 and windage turret 141, respectively. It shall be further noted that the elevation turret 140 and the windage turret 141 are responsible for adjusting the scope 130 along the vertical axis 160 and the horizontal axis 150, respectively, and are well known in the art pertaining to scopes.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rifle scope alignment assembly comprising:

a housing in which a horizontal alignment plate extends and retracts along a vertical axis;

wherein a vertical alignment plate attaches to the housing, and includes a plurality of vertical alignment lines extending along a horizontal axis, which are adaptively used to enable vertical alignment of an existing scope with respect to an existing rifle;

wherein a rubber band secures said assembly to said scope by encircling a rear surface of said assembly and a rearmost scope mount of said scope;

wherein the vertical alignment plate attaches onto a rear surface of the housing via screws;

wherein an ocular lens having cross hairs visible within is used to adjust the vertical alignment of the scope with respect to one of the vertical alignment lines of the vertical alignment plate;

wherein the cross hairs are further defined with a horizontal cross hair and a vertical cross hair; wherein the horizontal cross hair is aligned with one of the vertical alignment lines.

2. The rifle scope alignment assembly as described in claim 1 wherein the housing includes a vertical slot into which the horizontal alignment plate slides up or down along said vertical axis.

3. The rifle scope alignment assembly as described in claim 2 wherein the horizontal alignment plate includes a groove at a first distal end, which engages a top half of a rifle barrel of said rifle.

4. The rifle scope alignment assembly as described in claim 1 wherein the housing is further defined by a front surface from which scope rest pins extend rearwardly and which engage above and against an outer surface of an objective lens.

5. The rifle scope alignment assembly as described in claim 4 wherein a horizontal alignment triangle forms upon proper seating of the groove onto a top half of a rifle barrel in conjunction with proper placement of the scope rest pins above and against the outer surface of the objective lens.

6. The rifle scope alignment assembly as described in claim 1 wherein the housing, the horizontal alignment plate, and the vertical alignment plate are made of a translucent material that enables light to pass through.

7. The rifle scope alignment assembly as described in claim 1 wherein the vertical alignment lines are equally spaced and parallel with one another.

8. The rifle scope alignment assembly as described in claim 1 wherein the rubber band secures the assembly onto the scope before horizontal alignment and/or vertical alignment of the scope with respect to the rifle.

9. The rifle scope alignment assembly as described in claim 1 wherein the rubber band traverses a top edge of the vertical alignment plate, across a front surface of the vertical alignment plate, and then over a bottom edge.

10. A rifle scope alignment assembly comprising:

a housing in which a horizontal alignment plate extends and retracts along a vertical axis;

wherein a vertical alignment plate attaches to the housing, and includes a plurality of vertical alignment lines extending along a horizontal axis, which are adaptively used to enable vertical alignment of an existing scope with respect to a rifle;

wherein a rubber band secures said assembly to said scope by encircling a rear surface of said assembly and a rearmost scope mount of said scope;

wherein securement of the assembly to the scope occurs prior to horizontal alignment;

wherein horizontal alignment of the scope with respect to the rifle occurs prior to vertical alignment of the scope with respect to the rifle;

wherein an ocular lens having cross hairs visible within is used to adjust the vertical alignment of the scope with respect to one of the vertical alignment lines of the vertical alignment plate;

wherein vertical alignment and horizontal alignment of the scope with respect to the rifle requires manipulation of an elevation turret and a windage turret, respectively;

wherein the vertical alignment plate attaches onto a rear surface of the housing via screws; wherein the housing, the horizontal alignment plate, and the vertical alignment plate are made of a translucent material that enables light to pass through;

wherein the cross hairs are further defined with a horizontal cross hair and a vertical cross hair; wherein the horizontal cross hair is aligned with one of the vertical alignment lines.

11. The rifle scope alignment assembly as described in claim 10 wherein the housing includes a vertical slot into which the horizontal alignment plate slides up or down along said vertical axis.

12. The rifle scope alignment assembly as described in claim 11 wherein the horizontal alignment plate includes a groove at a first distal end, which engages a top half of a rifle barrel of said rifle; wherein the housing is further defined by a front surface from which scope rest pins extend rearwardly and which engage above and against an outer surface of an objective lens; wherein a horizontal alignment triangle forms upon proper seating of the groove onto a top half of a rifle barrel in conjunction with proper placement of the scope rest pins above and against the outer surface of the objective lens.

13. The rifle scope alignment assembly as described in claim 10 wherein the vertical alignment lines are equally spaced and parallel with one another.

14. The rifle scope alignment assembly as described in claim 10 wherein the rubber band secures the assembly onto the scope before horizontal alignment and/or vertical alignment of the scope with respect to the rifle.

15. The rifle scope alignment assembly as described in claim 10 wherein the rubber band traverses a top edge of the vertical alignment plate, across a front surface of the vertical alignment plate, and then over a bottom edge.

* * * * *